US011065901B2

(12) United States Patent
Ohnishi

(10) Patent No.: US 11,065,901 B2
(45) Date of Patent: Jul. 20, 2021

(54) TRANSFER METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 237 days.

(21) Appl. No.: 16/519,023

(22) Filed: Jul. 23, 2019

(65) Prior Publication Data

US 2020/0047533 A1 Feb. 13, 2020

(30) Foreign Application Priority Data

Aug. 10, 2018 (JP) ..... JP2018-151600

(51) Int. Cl.

| | |
|---|---|
| ***B41F 16/00*** | (2006.01) |
| ***B41M 5/025*** | (2006.01) |
| ***B42D 25/455*** | (2014.01) |
| ***B44C 1/17*** | (2006.01) |

(52) U.S. Cl.

CPC ..... *B41M 5/025* (2013.01); *B41F 16/0026* (2013.01); *B42D 25/455* (2014.10); *B44C 1/1712* (2013.01)

(58) Field of Classification Search

CPC ..... B41F 16/0026
USPC ..... 101/488
See application file for complete search history.

(56) References Cited

U.S. PATENT DOCUMENTS

2002/0047225 A1* 4/2002 Bruning ..... B29C 44/445 264/46.4
2011/0059284 A1* 3/2011 Butzloff ..... B29C 66/1122 428/57
2014/0227527 A1* 8/2014 Brors ..... F27B 14/10 428/411.1
2016/0189985 A1* 6/2016 Kasai ..... H01L 21/566 438/127
2017/0284096 A1* 10/2017 Abe ..... E06B 3/6715

OTHER PUBLICATIONS

Hamamatsu, "DGSHAPE Launches World's First Laser Foil Decorator", Mar. 16, 2008, Available at: https://www.rolanddg.com/en/news/2018/180316-dgshape-launches-worlds-first-laser-foil-decorator.

* cited by examiner

*Primary Examiner* — Anthony H Nguyen
(74) *Attorney, Agent, or Firm* — JCIPRNET

(57) ABSTRACT

A transfer method is provided and includes a disposing step of disposing a transfer sheet and a medium in an inside of a sealed space formed by using a pressure welding sheet having flexibility in at least one part; a pressure welding step of suctioning the inside of the sealed space by a negative pressure and pressure welding the pressure welding sheet and the medium by the negative pressure to closely attach the transfer sheet and the medium; an irradiating step of softening an adhesive layer of the transfer sheet by irradiation of a light ray in a state in which the transfer sheet is closely attached to the medium by the pressure welding sheet and adhering the adhesive layer to the medium by a pressure welding force from the pressure welding sheet; and a peeling step of peeling off the transfer sheet from the medium after the irradiating step.

10 Claims, 10 Drawing Sheets

TRANSFER METHOD

CROSS REFERENCE TO RELATED APPLICATIONS

This application claims the priority benefit of Japanese Patent Application No. 2018-151600, filed on Aug. 10, 2018. The entirety of the above-mentioned patent application is hereby incorporated by reference herein and made a part of this specification.

TECHNICAL FIELD

The present disclosure relates to a transfer method.

DESCRIPTION OF THE BACKGROUND ART

Conventionally, when transferring a metal foil onto a medium, for example, a method of placing a transfer sheet including a metal foil layer and an adhesive layer on a transfer target surface of the medium, and irradiating the transfer sheet with a laser light while the transfer sheet is pressed against the transfer target surface by a pressure welding sheet is known (see e.g., Internet URL: https://www.rolanddg.com/en/news/2018/180316-dgshape-launches-worlds-first-laser-foil-decorator, Non-Patent Literature 1). In this method, the pressure welding sheet or the transfer sheet generate heat by receiving the laser light, which heat causes the adhesive layer to soften and adhere to the transfer target surface. Thus, the metal foil of a part subjected to the laser light is transferred to the transfer target surface.

Non-Patent Literature 1:

Internet URL: https://www.rolanddg.com/en/news/2018/180316-dgshape-launches-worlds-first-laser-foil-decorator

SUMMARY

In the transfer method described above, a configuration in which the pressure welding sheet is stretched across an inner peripheral side of a frame member is adopted, and the pressure welding sheet pressure welds the transfer sheet by pressing the frame member against the medium side. Thus, when transferring the metal foil to a medium having uneven transfer target surface, it is difficult to sufficiently pressure weld the pressure welding sheet to a bottom portion of a recess of the transfer target surface, and it is difficult to transfer the metal foil with high accuracy.

In light of the foregoing, the present disclosure provides a transfer method capable of transferring a transfer layer with high accuracy even to a medium having uneven transfer target surface.

A transfer method according to the present disclosure includes a disposing step of disposing a transfer sheet and a medium in an inside of a sealed space, and the sealed space is formed using a pressure welding sheet having flexibility in at least one part, and the transfer sheet and the medium are disposed so that an adhesive layer of the transfer sheet and a transfer layer of the transfer sheet are layered, and the adhesive layer has a thermally melting property, and the adhesive layer is contacted with the medium; a pressure welding step of suctioning the inside of the sealed space by a negative pressure and pressure welding the pressure welding sheet and the medium by the negative pressure to closely attach the transfer sheet and the medium; an irradiating step of softening the adhesive layer by irradiation of a light ray generated from a light source in a state the transfer sheet is closely attached to the medium by the pressure welding sheet and adhering the adhesive layer to the medium by a pressure welding force from the pressure welding sheet; and a peeling step of peeling off the transfer sheet from the medium after the irradiating step.

In this configuration, the transfer sheet can be pressure welded to the medium in a state the pressure welding sheet is deformed so as to follow an uneven portion of a transfer target surface of the medium by generating the negative pressure between the flexible pressure welding sheet and the medium. Thus, the transfer layer can be transferred with high accuracy even to the medium on which the uneven portion is formed.

In the transfer method described above, the pressure welding sheet may be formed of a member that transmits the light ray, and in the irradiating step, the light ray may be incident from a side of the transfer sheet.

Thus, the light ray generated from the light source can easily reach the transfer layer of the transfer sheet.

In the transfer method described above, the transfer layer may be formed of a metal foil layer, and in the irradiating step, the adhesive layer may be thermally melted when a heat generating layer disposed on a front side in an incident direction of the light ray in the metal foil layer generates heat by the light ray.

Thus, the heat generating layer can be provided above the metal foil layer which does not transmit light, and the heat generating layer is may be caused to generate heat by a light ray to thermally fuse the adhesive and easily transfer the metal foil layer. Therefore, for example, the metallic color can be easily formed on the medium M.

In the transfer method described above, the heat generating layer may be formed on the pressure welding sheet.

Thus, the handling property of the pressure welding sheet can be improved.

In the transfer method described above, the pressure welding step may include: accommodating the medium and the transfer sheet in an inside of a bag body formed by using the pressure welding sheet, and generating the negative pressure between the pressure welding sheet and the medium by suctioning the inside of the bag body.

Accordingly, the negative pressure is generated between the pressure welding sheet and the medium without requiring a complicated operation.

In the transfer method described above, the transfer method may further include: a mounting step of mounting the medium on a mounting portion of a jig formed with the mounting portion for mounting the medium. In the pressure welding step, the inside of the sealed space may be suctioned by the negative pressure, and the pressure welding sheet and the jig may be pressure welded by the negative pressure to closely attach the transfer sheet and the medium.

Thus, the deformation of the medium can be suppressed when generating the negative pressure between the pressure welding sheet and the medium.

In the transfer method, in the disposing step, the transfer sheet and the medium may be accommodated inside a cup-shaped container from an opening portion of the cup-shaped container having the opening portion in which an upper surface side is opened, and the sealed space may be formed by closing the opening portion of the cup-shaped container with a closing member in which at least one part is made of the pressure welding sheet.

Accordingly, automation of each step of the pressure welding step and the irradiating step is facilitated.

According to the aspect of the present disclosure, the transfer layer can be transferred with high accuracy even to a medium in which the transfer target surface is uneven.

DESCRIPTION OF EMBODIMENTS

Hereinafter, embodiments of a transfer method according to the present disclosure will be described based on the drawings. The present disclosure is not limited by the embodiments. Furthermore, the configuring elements in the following embodiments include those that can be replaced by a person skilled in the art and those that are easy or substantially the same.

First Embodiment

Figure 1:
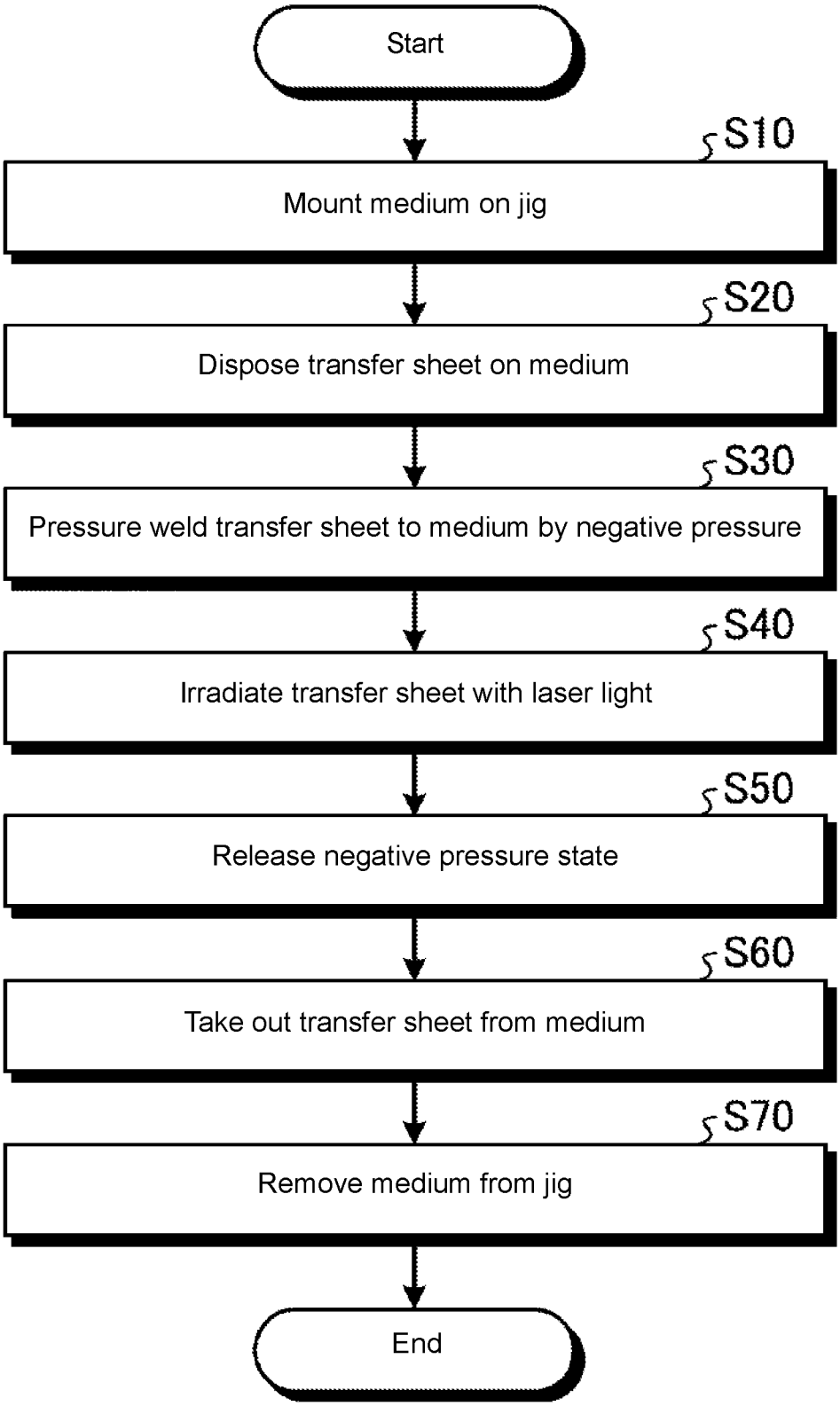
FIG. 1 is a flowchart showing an example of a transfer method according to a first embodiment.
Figure 4:
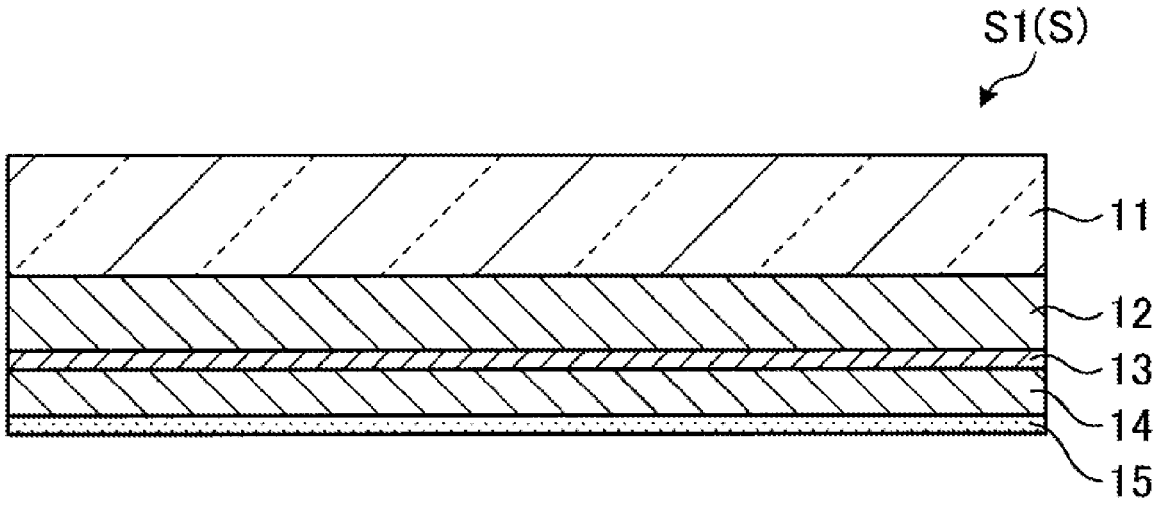
FIG. 4 is a view showing an example of a transfer sheet.
Figure 5:
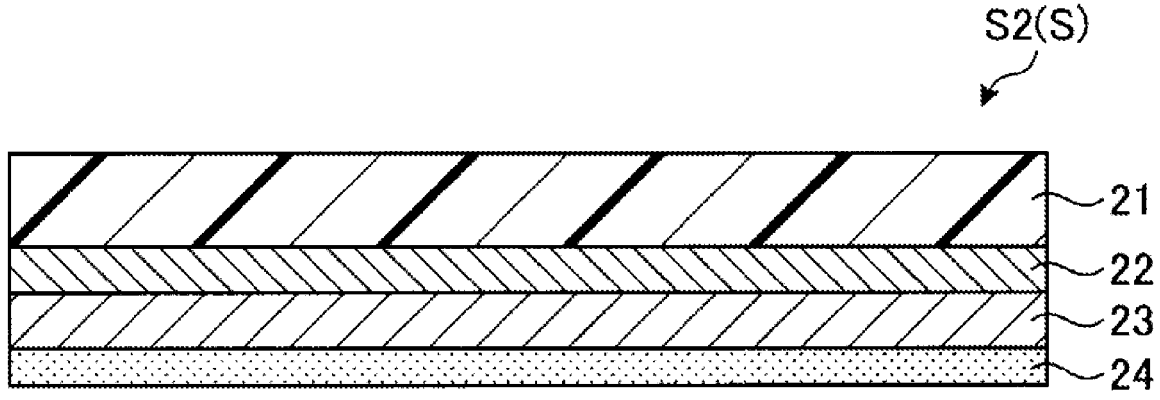
FIG. 5 is a view showing another example of the transfer sheet.
Figure 8:
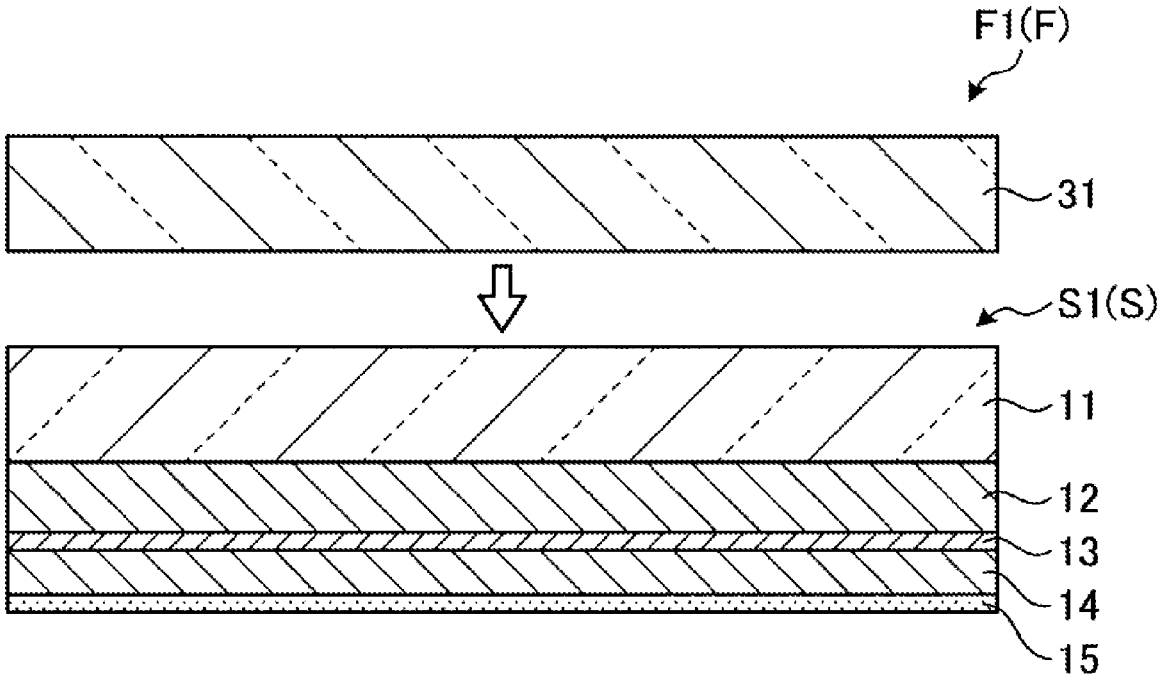
FIG. 8 is a view showing an example of a pressure welding sheet.
Figure 9:
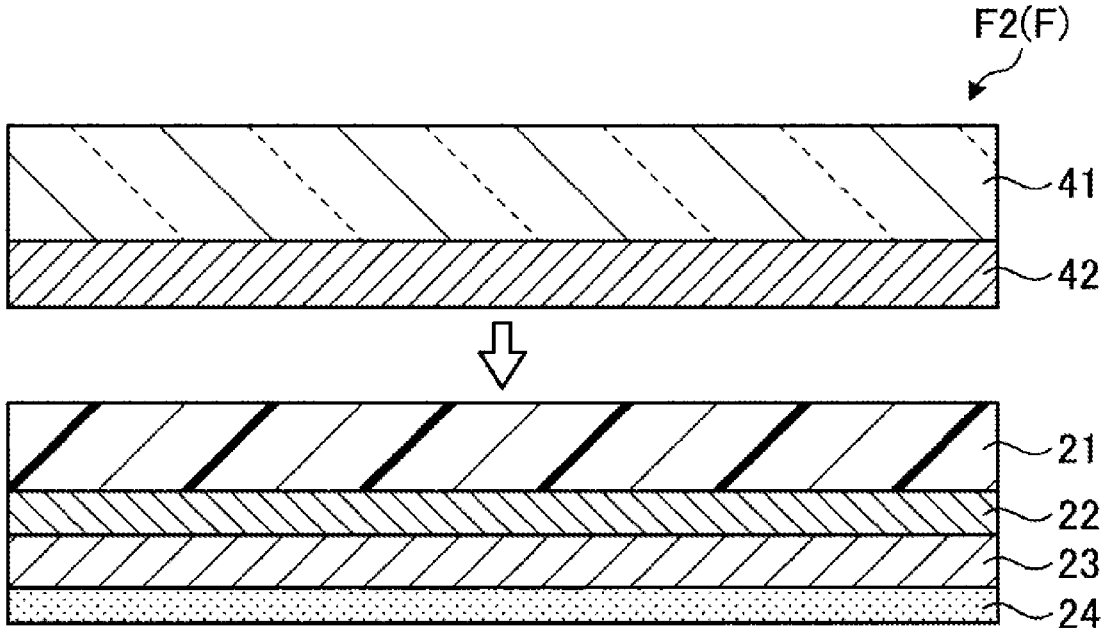
FIG. 9 is a view showing another example of the pressure welding sheet.

FIG. 1 is a flowchart showing an example of a transfer method according to a first embodiment. FIGS. 2 to 13 are views showing each step of the transfer method according to the first embodiment. FIGS. 4 and 5 are views showing examples of a transfer sheet used in the transfer method. FIGS. 8 and 9 are views showing examples of a pressure welding sheets used in the transfer method. The transfer method according to the first embodiment will be described below with reference to FIGS. 1 to 13.

In the transfer method according to the present embodiment, a metal foil is transferred as a transfer layer to a transfer target surface Ma on which uneven portion Mb are formed in a medium M. As such medium M, for example, a small three-dimensional object such as a case of an electronic device including a smartphone and a tablet or a key chain may be used, or a large three-dimensional object such as a door or a window glass may be used.

Figure 2:
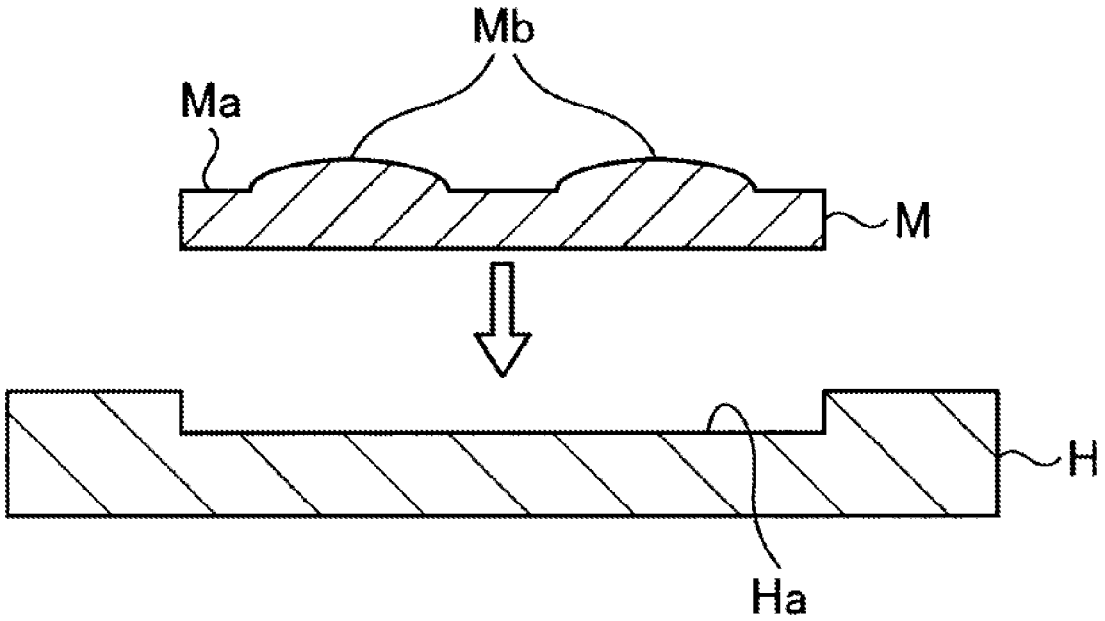
FIG. 2 is a view showing a step of the transfer method according to the first embodiment.

As shown in FIG. 2, first, the medium M to be a transfer target of the metal foil is held by a jig H (mounting step S10). The jig H used in the mounting step S10 includes a mounting portion Ha for holding the medium M. The mounting portion Ha is set in advance so as to have a dimension corresponding to the medium M. The jig H suppresses deformation of the medium M in the following steps.

Figure 3:
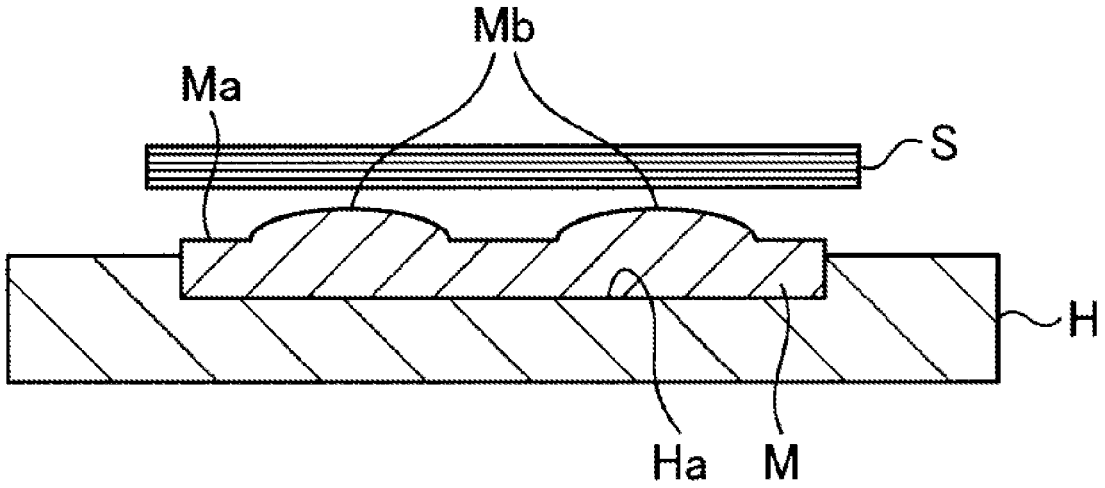
FIG. 3 is a view showing a step of the transfer method according to the first embodiment.

After the mounting step S10, as shown in FIG. 3, a transfer sheet S is disposed on a transfer target surface Ma of the medium M held by the jig H (disposing step S20). The transfer sheet S has flexibility, and includes a layer of metal foil to be transferred to the medium M. Here, a specific configuration of the transfer sheet S will be described.

FIG. 4 is a view showing an example of the transfer sheet. The transfer sheet S1 shown in FIG. 4 includes a base layer 11, a heat generating layer 12, a mold release protective layer 13, a metal foil layer 14, and an adhesive layer 15. As the base layer 11, for example, a transparent film capable of transmitting light such as an infrared laser is used. The heat generating layer 12 is disposed on one surface of the base layer 11. The heat generating layer 12 locally generates heat in an irradiation region by being irradiated with light such as an infrared laser. The heat generating layer 12 is formed using, for example, a material such as a silicone resin, a fluorine resin, or a polyimide resin.

The mold release protective layer 13 is disposed between the heat generating layer 12 and the metal foil layer 14. The mold release protective layer 13 is adhered to the metal foil layer 14, and holds the metal foil layer 14 on the heat generating layer 12 side. The mold release protective layer 13 can be melted, for example, by heat. The metal foil layer 14 is formed to a thin film shape, for example, with a metal such as aluminum. The adhesive layer 15 is formed using, for example, a thermoplastic material, and can be adhered to a target object by being melted by heat. In the transfer sheet S1, the mold release protective layer 13 may not be provided, and may be separated into the layers of the base layer 11 and the heat generating layer 12 and the layers of the metal foil layer 14 and the adhesive layer 15.

FIG. 5 is a view showing another example of the transfer sheet. A transfer sheet S2 shown in FIG. 5 includes a base layer 21, a mold release protective layer 22, a metal foil layer 23, and an adhesive layer 24. The base layer 21 uses a film formed using a material such as a resin. The base layer 21 may not be transparent. The mold release protective layer 22 can be melted by heat, and holds the metal foil layer 23 on the base layer 21 side. The metal foil layer 23 is formed to a thin film shape, for example, with a metal such as aluminum. The adhesive layer 24 is formed using, for example, a thermoplastic material, and can be adhered to a target object by being softened by heat. Similarly to the case of the transfer sheet S1, the adhesive force of the mold release protective layer 22 may be such that it can hold the metal foil layer 23 so as not to peel off. Furthermore, the adhesive force of the adhesive layer 24 is larger than the adhesive force of the mold release protective layer 22 in the softened state.

Figure 6:
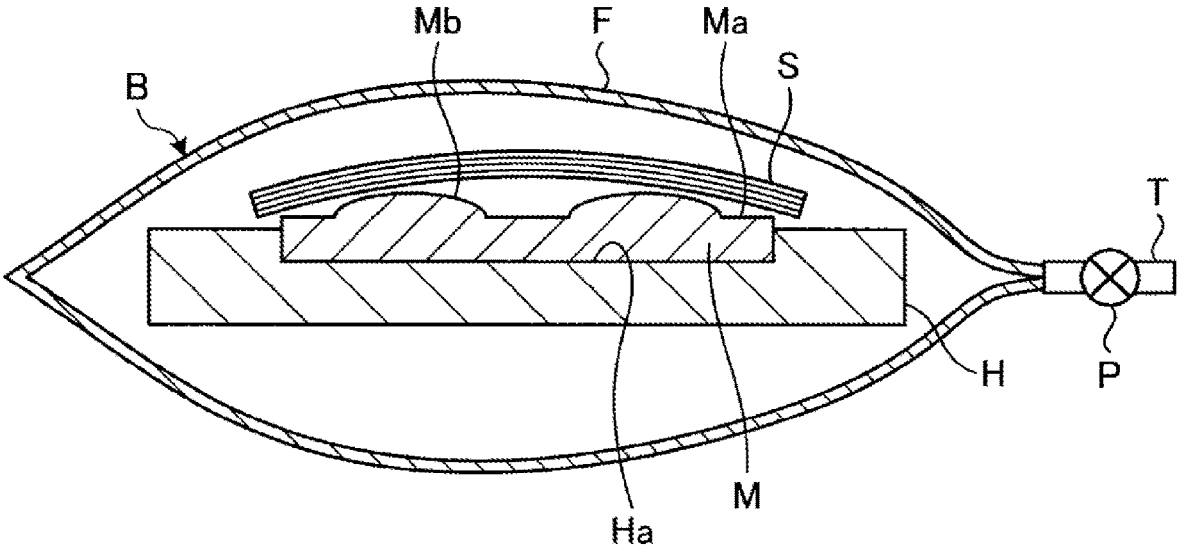
FIG. 6 is a view showing a step of the transfer method according to the first embodiment.

After the disposing step S20, the transfer sheet S is pressure welded to the medium M by a negative pressure (pressure welding step S30). In the pressure welding step S30, first, as shown in FIG. 6, the medium M mounted to the jig H and the transfer sheet S disposed on the medium M are accommodated in an inside of a bag body B formed using the pressure welding sheet F. Then, an opening portion of the bag body B is attached to one end of a tube member T to which a pump P is attached. Thus, the inside of the bag body B is communicated with the outside through the tube member T.

Figure 7:
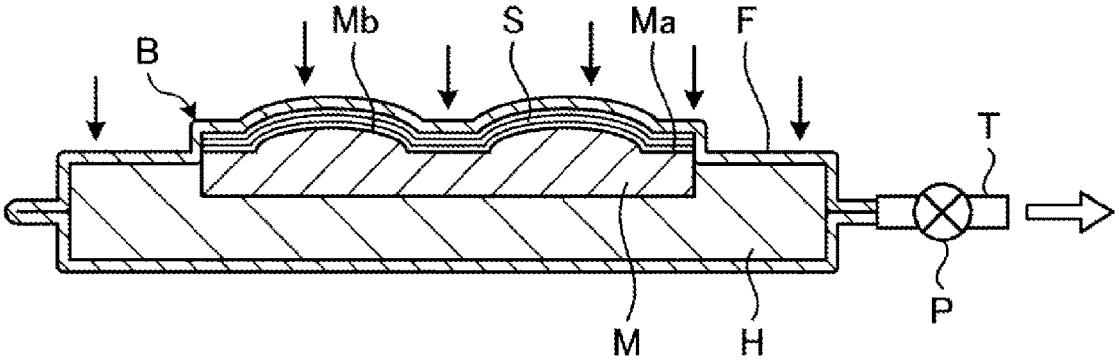
FIG. 7 is a view showing a step of the transfer method according to the first embodiment.

In this state, as shown in FIG. 7, a negative pressure is generated in the inside of the bag body B, that is, between the pressure welding sheet F and the medium M by operating the pump P to suction the inside of the bag body B. The negative pressure causes the air in the inside of the bag body B to be discharged to the outside through the tube member T, and the pressure welding sheet F to be adsorbed to the medium M and the jig H. The transfer sheet S is pressure welded to the medium M by the adsorption force (pressure by negative pressure) of the pressure welding sheet F.

Thus, by generating a negative pressure between the pressure welding sheet F having flexibility and the medium M, even when the uneven portion Mb are formed on the transfer target surface Ma of the medium M, the pressure welding sheet F is adsorbed to the transfer target surface Ma so as to follow the shape of the uneven portion Mb. Therefore, the transfer sheet S disposed between the pressure welding sheet F and the medium M closely attaches along the transfer target surface Ma of the medium M. In a state in which the pressure welding sheet F is pressure welded to the medium M, atmospheric pressure acts on the entire surface of the pressure welding sheet F, so that the transfer sheet S is in pressure weld with the medium M at a uniform pressure.

In the pressure welding step S30, the pressure welding sheet F may have a configuration corresponding to the type of transfer sheet S. FIG. 8 is a view showing an example of the pressure welding sheet F. A pressure welding sheet F1 shown in FIG. 8 includes a transparent sheet 31. The transparent sheet 31 is formed using, for example, a material such as polyimide and polypropylene, and can transmit light such as an infrared laser. The pressure welding sheet F1 shown in FIG. 8 can be used, for example, with respect to the transfer sheet S including the heat generating layer 12 as with the transfer sheet S1 shown in FIG. 4. That is, when the transfer sheet S1 including the heat generating layer 12 is used, a heat generating layer may not be provided on the pressure welding sheet F1.

FIG. 9 is a view showing another example of the pressure welding sheet F. A pressure welding sheet F2 shown in FIG. 9 includes a transparent sheet 41 and a heat generating layer 42. The transparent sheet 41 is formed using, for example, a material such as polyimide and polypropylene, and can transmit light such as an infrared laser. The heat generating layer 42 generates heat by being irradiated with light such as an infrared laser. The heat generating layer 12 is formed using, for example, a material such as a silicone resin, a fluorine resin, or a polyimide resin. The pressure welding sheet F2 shown in FIG. 9 is used, for example, with respect to the transfer sheet S not including the heat generating layer as with the transfer sheet S2 shown in FIG. 5. That is, when the transfer sheet S2 not including the heat generating layer is used, the pressure welding sheet F2 provided with the heat generating layer 42 is used.

Figure 10:
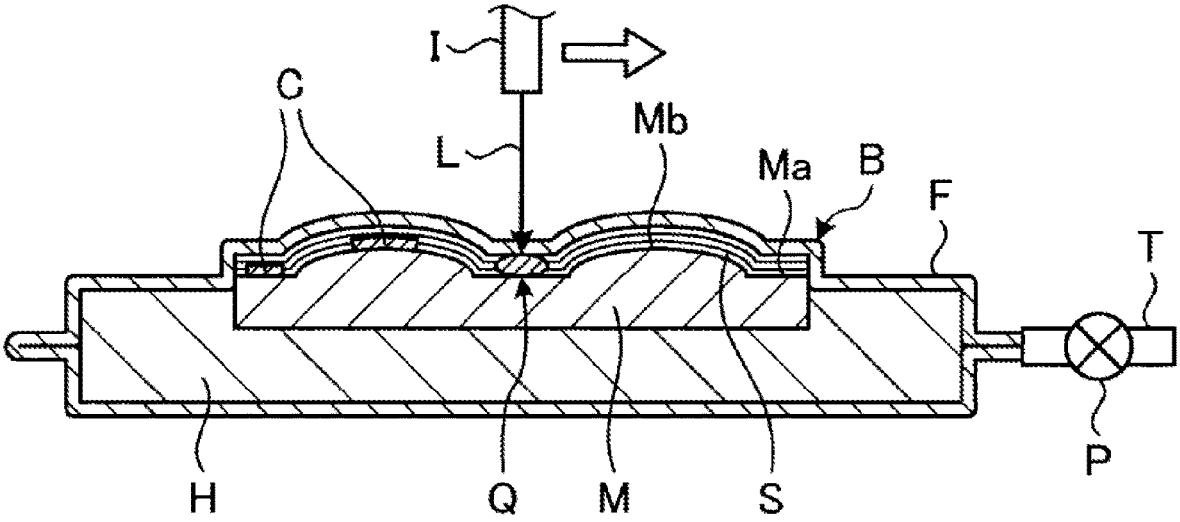
FIG. 10 is a view showing a step of the transfer method according to the first embodiment.

After the pressure welding step S30, the transfer sheet S is irradiated with a laser light (irradiating step S40). In the irradiating step S40, as shown in FIG. 10, the transfer sheet S is irradiated with the laser light L by the irradiation device I in a state where the transfer sheet S is pressure welded to the medium M by the pressure welding sheet F. The irradiation device I irradiates the transfer sheet S with the laser light L through the pressure welding sheet F. The irradiation device I can irradiate the laser light L while moving on the transfer sheet S. In an irradiation region Q of the transfer sheet S to where the laser light L is irradiated, the laser light L is absorbed by the heat generating layer 12 or the heat generating layer 42, and heat is locally generated.

When the transfer sheet S1 is used, the heat generated in the heat generating layer 12 melts the mold release protective layer 13 and softens the adhesive layer 15. When the transfer sheet S2 is used, the heat generated in the heat generating layer 42 melts the mold release protective layer 22 and softens the adhesive layer 24. In the present embodiment, since the transfer sheet S is pressure welded to the medium M by the pressure welding sheet F, a softened part G of the adhesive layer 15 or the adhesive layer 24 softened by heat is pressed against the medium M, and adheres to the transfer target surface Ma. The softened part G also adheres to the metal foil layer 14, 23 side.

Figure 11:
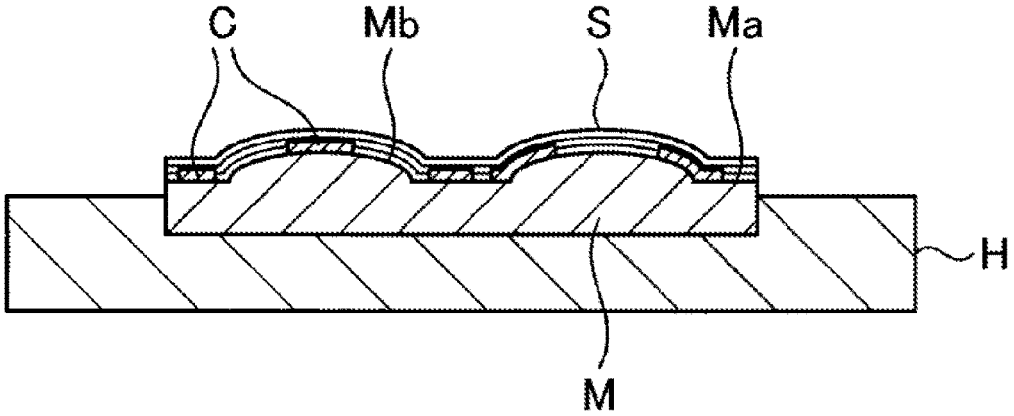
FIG. 11 is a view showing a step of the transfer method according to the first embodiment.

After the irradiating step S40, the pump P is stopped to release the negative pressure state in the inside of the bag body B, and the medium M, the jig H and the transfer sheet S are taken out from the inside of the bag body B as shown in FIG. 11 (releasing step S50). In the releasing step S50, since the softened part G of the transfer sheet S is in a state of being adhered to the medium M, the medium M, the jig H and the transfer sheet S are integrally taken out.

Figure 12:
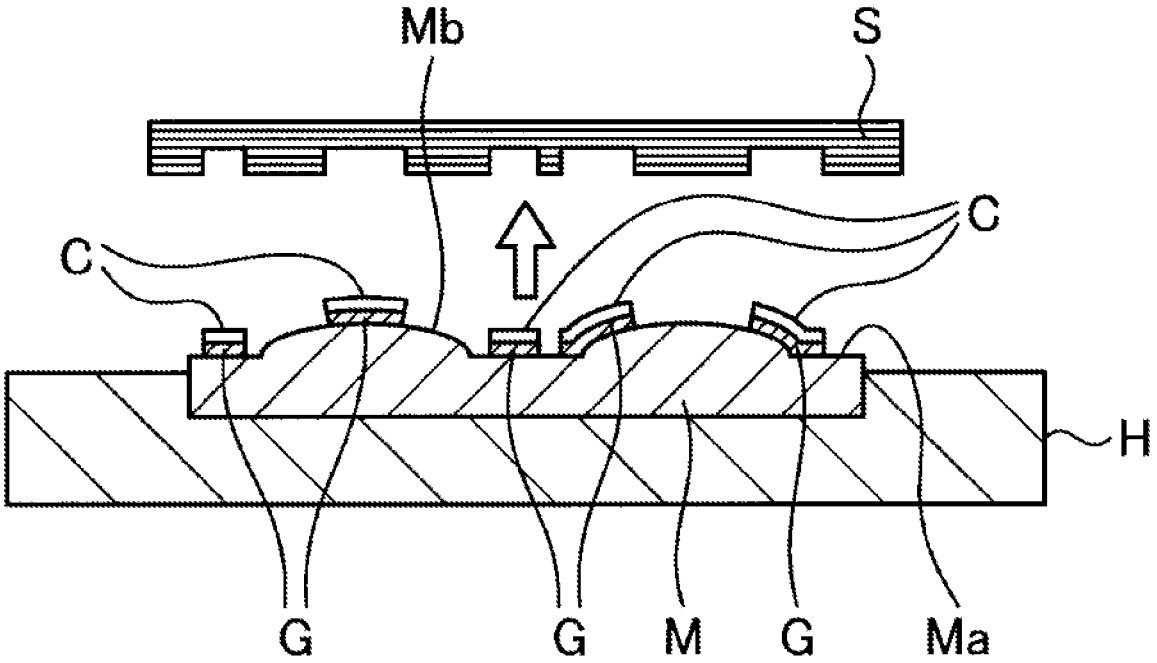
FIG. 12 is a view showing a step of the transfer method according to the first embodiment.

After the releasing step S50, as shown in FIG. 12, the transfer sheet S is peeled from the medium M (peeling step S60). Of the adhesive layer 15, 24 of the transfer sheet S, the softened part G is adhered to the transfer target surface Ma of the medium M by the pressure welding step S30 and the irradiating step S40. Furthermore, of the metal foil layer 14, 23, a part C overlapping with the softened part G is adhered to the softened part G (hereinafter, referred to as an adhered part C). Moreover, the part overlapping the adhered part C in the mold release protective layer 13, 22 is melted, and the holding force with respect to the adhered part C is lowered. Therefore, by peeling off the transfer sheet S, the softened part G of the adhesive layer 15, 24 and the adhered part C of the metal foil layer 14, 23 remain on the medium M. On the other hand, parts of the metal foil layer 14, 23 other than the adhered part C are adhered to the mold release protective layer 13, 22 and therefore, are separated from the adhered part C when the transfer sheet S is peeled off and are peeled off with the transfer sheet S.

Figure 13:
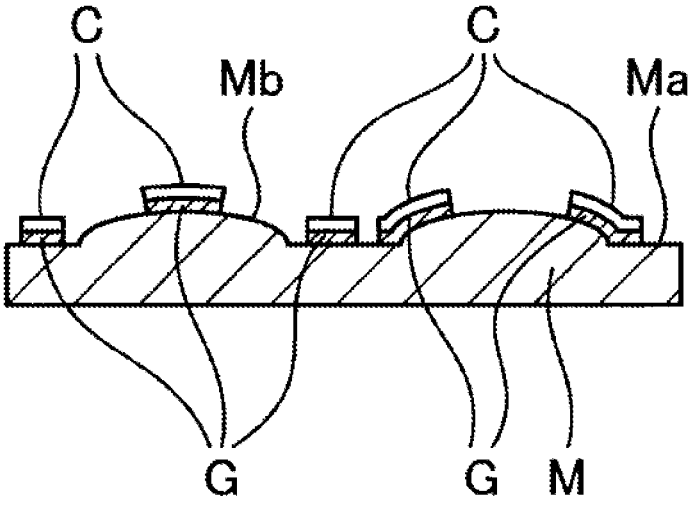
FIG. 13 is a view showing a step of the transfer method according to the first embodiment.

After the peeling step S60, as shown in FIG. 13, the medium M is removed from the jig H (removing step S70). According to the removing step S70, the medium M in a state in which a part of the metal foil layer 14, 23 is transferred to the transfer target surface Ma as the adhered part C is obtained. The adhered part C is provided in a state of being adhered along the uneven portion Mb of the transfer target surface Ma.

As described above, the transfer method according to the present embodiment includes a disposing step of disposing the transfer sheet S and the medium M by layering the adhesive layer 15 of the transfer sheet S, in which the adhesive layer 15 and the metal foil layer 14 which is the transfer layer are layered in an inside of a sealed space formed using the pressure welding sheet F having flexibility in at least one part, so as to make contact with the medium; a pressure welding step of suctioning the inside of the sealed space by negative pressure and pressure welding the pressure welding sheet F and the medium M by the negative pressure to closely attach the transfer sheet S and the medium M; an irradiating step of softening the adhesive layer 15 by irradiation of a light ray generated from the irradiation device I which is a light source in a state the transfer sheet S is closely attached to the medium M by the pressure welding sheet F and adhering the adhesive layer 15 to the medium M by a pressure welding force from the pressure welding sheet F, and a peeling step of peeling off the transfer sheet S from the medium M after the irradiating step.

In this configuration, the transfer sheet S can be pressure welded to the medium M in a state the pressure welding sheet F is deformed so as to follow the uneven portion Mb of the transfer target surface Ma of the medium M by generating the negative pressure between the flexible pressure welding sheet F and the medium M. Thus, the metal foil which is the transfer layer can be transferred with high accuracy even to the medium M in which the uneven portion Mb is formed.

In the transfer method according to the present embodiment, the pressure welding sheet F is formed of a member that transmits a light ray, and in the irradiating step, the light ray is incident from the transfer sheet F side. The light ray generated from the irradiation device I thus can easily reach the metal foil layer 14 of the transfer sheet F.

In the transfer method according to the present embodiment, the transfer layer is formed of the metal foil layer 14, and in the irradiating step, the heat generating layer 12 disposed on the front side in the incident direction of the light ray in the metal foil layer 14 generates heat by the light ray thus thermally melting the adhesive layer 15. Thus, the heat generating layer 12 is provided above the metal foil layer 14 which does not transmit light, and the heat generating layer 12 is caused to generate heat by a light ray to thermally fuse the adhesive layer 15 and easily transfer the metal foil layer 14. Therefore, for example, the metallic color can be easily formed on the medium M.

In the transfer method according to the present embodiment, the heat generating layer 15 is formed on the pressure welding sheet F. Thus, the handling property of the pressure welding sheet F can be improved.

In the transfer method according to the present embodiment, the pressure welding step includes accommodating the medium M and the transfer sheet S in the bag body B formed using the pressure welding sheet F, and suctioning the inside of the bag body B to generate a negative pressure between the pressure welding sheet F and the medium M. Accordingly, the negative pressure is generated between the pressure welding sheet F and the medium M without requiring a complicated operation. In addition, the metal foil can be easily transferred with high accuracy even to a large medium M such as a door or a window glass.

The transfer method according to the present embodiment further includes a mounting step of mounting the medium M on the mounting portion Ha of the jig H, in which the mounting portion Ha for mounting the medium M is formed, where the pressure welding step includes suctioning the inside of the sealed space with negative pressure and pressure welding the pressure welding sheet F and the jig H by the negative pressure to closely attach the transfer sheet S and the medium M. Thus, the deformation of the medium M can be suppressed when generating the negative pressure between the pressure welding sheet F and the medium M.

Second Embodiment

Next, a second embodiment will be described. FIGS. 14 to 19 are views showing each step of a transfer method according to the second embodiment. In the present embodiment, the pressure welding method in the pressure welding step is different from that of the first embodiment.

Figure 14:
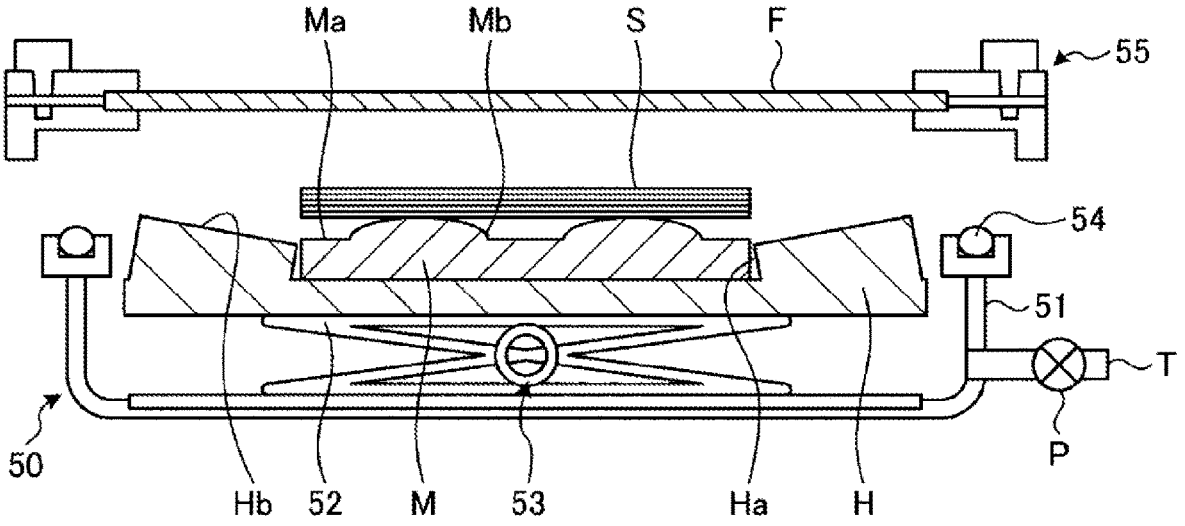
FIGS. 14 to 19 are views showing each step of a transfer method according to a second embodiment.
Figure 15:
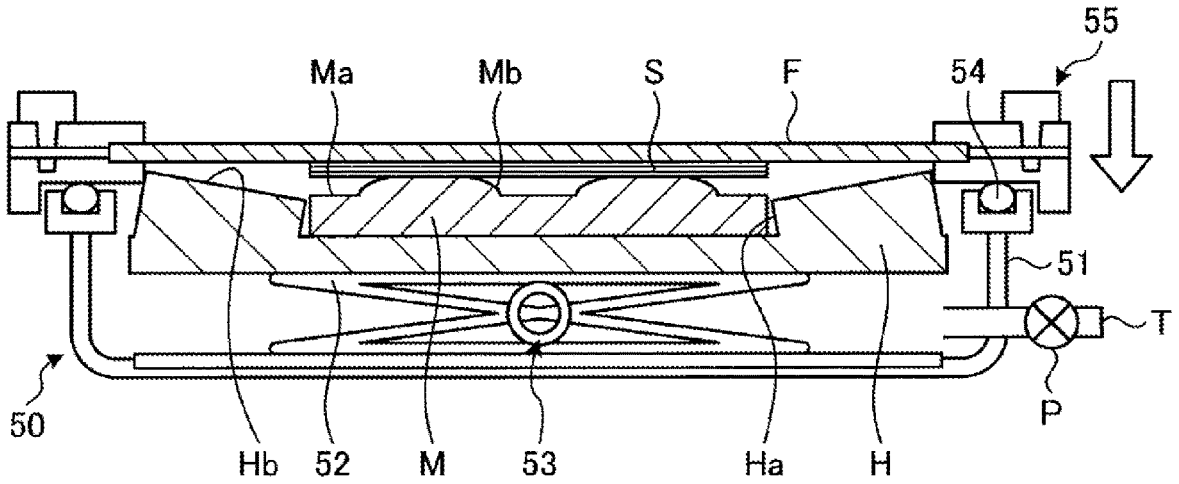

First, as shown in FIG. 14, the medium M to be a transfer target of the metal foil is held by the jig H (mounting step). The jig H used in the mounting step may have the same configuration as that of the first embodiment, or may have a configuration in which the upper surface Hb is inclined so as to become lower from the outer peripheral side to the inner peripheral side as shown in FIG. 14. The jig H may not be used.

After the mounting step, the jig H on which the medium M is mounted is mounted on a mounting stand 52 of a pressure welding device 50. The pressure welding device 50 includes a cup-shaped member 51, the mounting stand 52, a height adjustment unit 53, an O-ring 54, and a closing member 55. The cup-shaped member 51 has an opening portion in which the upper surface side is opened. The cup-shaped member 51 accommodates the medium M mounted on the jig H and the transfer sheet S. The tube member T is connected to the cup-shaped member 51, and the pump P is mounted to the tube member T. The inside of the cup-shaped member 51 can be suctioned by operating the pump P. The mounting stand 52 is disposed in the cup-shaped member 51, and the jig H is mounted thereon. When the jig H is not used, the medium M is directly mounted on the mounting stand 52. The height adjustment unit 53 adjusts the height of the mounting stand 52. The O-ring 54 is provided at the edge of the cup-shaped member 51. The closing member 55 has a frame-shape, has a shape along the edge of the cup-shaped member 51 in plan view, and has the pressure welding sheet F is disposed on the inner side. The closing member 55 is removable from the cup-shaped member 51.

After mounting the jig H on the mounting stand 52, the transfer sheet S is disposed on the transfer target surface Ma of the medium M held by the jig H (disposing step). The transfer sheet S may be either the transfer sheet S1 or the transfer sheet S2 described in the above embodiment.

After the disposing step, the closing member 55 is mounted to the cup-shaped member 51, as shown in FIG. 14. The closing member 55 is mounted on the cup-shaped member 51 while pressure welding the O-ring 54. Thus, the internal space K of the cup-shaped member 51 is sealed by the closing member 55, the pressure welding sheet F on the inner side the closing member 55, and the O-ring 54.

Figure 16:
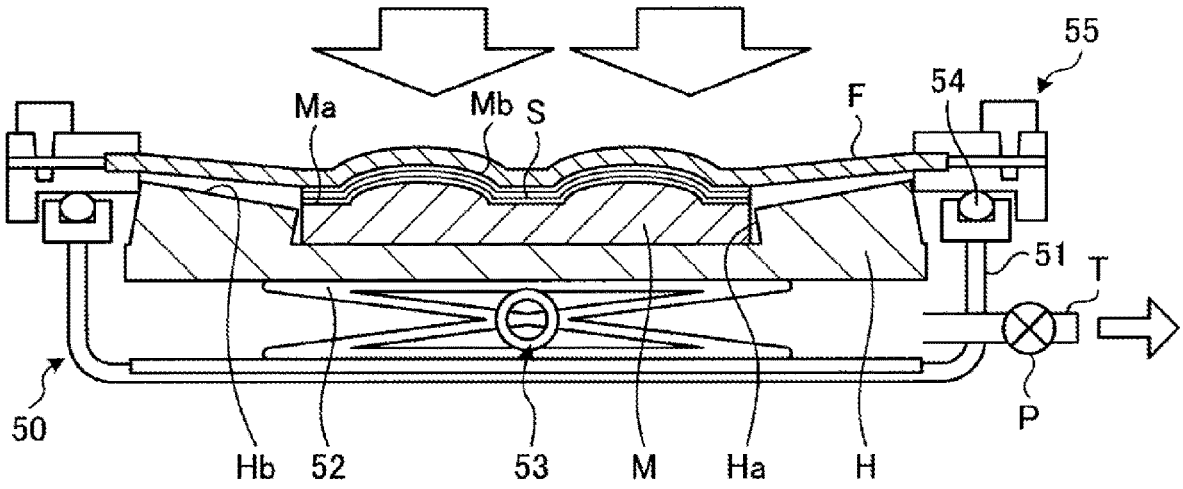

After mounting the closing member 55, as shown in FIG. 16, the pump P is operated to suction the internal space K. A negative pressure is generated between the pressure welding sheet F and the medium M by suctioning the internal space K. The air in the internal space K is discharged to the outside through the tube member T by such negative pressure, and the pressure welding sheet F is adsorbed to the medium M and the jig H. The transfer sheet S is pressure welded to the medium M by the adsorption force (pressure by negative pressure) of the pressure welding sheet F (pressure welding step).

Figure 17:
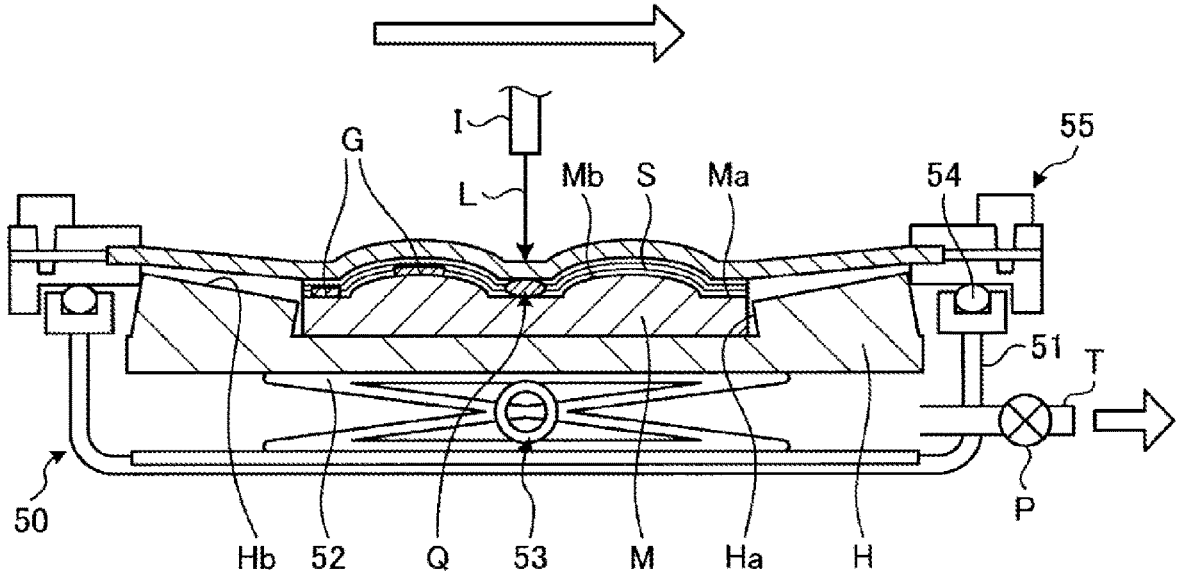

After the pressure welding step, the transfer sheet S is irradiated with a laser light (irradiating step). In the irradiating step, as shown in FIG. 17, the transfer sheet S is irradiated with the laser light L by the irradiation device I in a state where the transfer sheet S is pressure welded to the medium M by the pressure welding sheet F. The irradiation device I irradiates the transfer sheet S with the laser light L through the pressure welding sheet F. In an irradiation region Q of the transfer sheet S to where the laser light L is irradiated, the laser light L is absorbed by the heat generating layer 12 or the heat generating layer 42, and heat is locally generated. This heat forms a softened part G on the adhesive layer of the transfer sheet S. Since the transfer sheet S is pressure welded to the medium M by the pressure welding sheet F, the softened part G is pressed against the medium M and adheres to the transfer target surface Ma. The softened part G also adheres to the metal foil layer side of the transfer sheet S.

Figure 18:
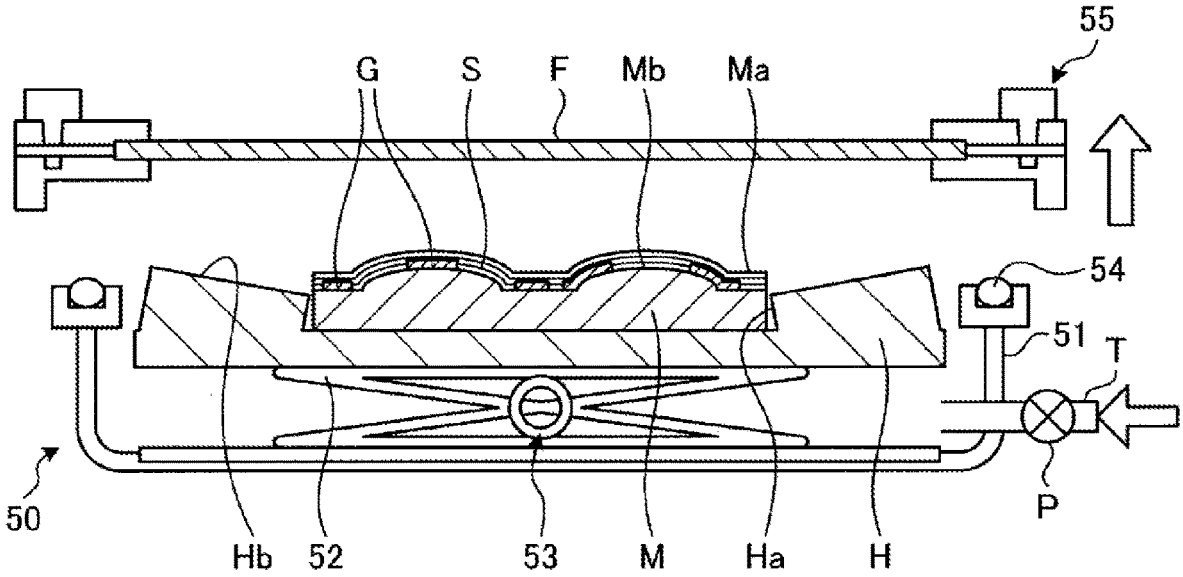
Figure 19:
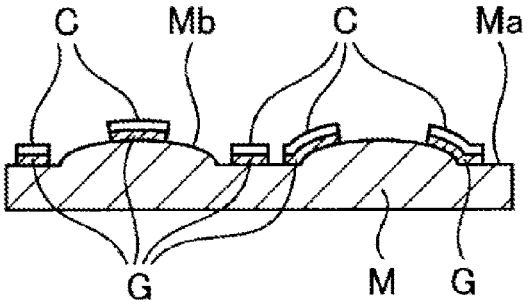

After the irradiating step, as shown in FIG. 18, the pump P is stopped to release the negative pressure state of the internal space K, the closing member 55 is removed from the cup-shaped member 51, and the medium M, the jig H and the transfer sheet S are taken out from the inside of the cup-shaped member 51 (releasing step). After the releasing step, the transfer sheet S is peeled from the medium M (peeling step). In the peeling step, as shown in FIG. 19, the softened part G of the adhesive layer and the adhered part C of the metal foil layer remain on the medium M. On the other hand, parts of the metal foil layer other than the adhered part C are separated from the adhered part C when the transfer sheet S is peeled off, and are peeled off with the transfer sheet S.

Thus, according to the transfer method according to the present embodiment, in the disposing step, the transfer sheet S and the medium M are accommodated in the inside of the cup-shaped container 51 from the opening portion of the cup-shaped container 51 having the opening portion in which the upper surface side is opened, and the opening portion of the cup-shaped container 51 is closed by the closing member 55 in which at least one part is formed of the pressure welding sheet F to form a sealed space. Accordingly, automation of each step of the pressure welding step and the irradiating step is facilitated.

The technical scope of the present disclosure is not limited to the above embodiments, and appropriate modifications can be made without departing from the scope of the present disclosure. For example, a case of transferring the metal foil to the medium M has been described by way of example in each of the embodiments described above, but the above embodiments can be applied even in the case of transferring a hologram or the like.

Furthermore, a case where the metal foil is transferred to the medium M in the state in which nothing is formed in the transfer target surface Ma has been described by way of example in the embodiments described above, but this is not the sole case. For example, the transfer method described above can be applied even to a case where the metal foil is transferred to the medium M in a state where color ink is formed on the transfer target surface Ma by an inkjet printer or the like. This enables color metallic printing on the medium M.

In the embodiments described above, the case where the heat generating layer 12 and 42 is provided on the transfer sheet S or the pressure welding sheet F, and the adhesive layer 15, 24 is melted by irradiating the heat generating layer 12, 42 with the laser light L as a light ray has been described by way of example, but this is not the sole case. For example, when irradiating a transparent adhesive layer with an ultraviolet laser light as a light ray, the adhesive layer can generate heat without providing a heat generating layer. Furthermore, in a case where a laser light using light having a wavelength longer than that of the infrared light as a light ray is used, a substance having a high polarizability such as water can be vibrated and heated. Therefore, in such a case, the heat generating layer 12 and 24 may not be provided.

Moreover, in the embodiments described above, the case where the metal foil layer 14, 23 is transferred as a transfer layer has been described by way of example, but this is not the sole case. The transfer layer may be a layer other than a metal foil, such as, for example, a layer of an image formed by usual step colors.

What is claimed is:

1. A transfer method comprising:

a disposing step of disposing a transfer sheet and a medium in an inside of a sealed space, wherein the sealed space is formed by using a pressure welding sheet having flexibility in at least one part, and the transfer sheet and the medium are disposed so that an adhesive layer of the transfer sheet and a transfer layer of the transfer sheet are layered, and the adhesive layer has a thermally melting property, and the adhesive layer is contacted with the medium;

a pressure welding step of suctioning the inside of the sealed space by a negative pressure and pressure welding the pressure welding sheet and the medium by the negative pressure to closely attach the transfer sheet and the medium;

an irradiating step of softening the adhesive layer by irradiation of a light ray generated from a light source in a state in which the transfer sheet is closely attached to the medium by the pressure welding sheet and adhering the adhesive layer to the medium by a pressure welding force from the pressure welding sheet; and a peeling step of peeling off the transfer sheet from the medium after the irradiating step.

2. The transfer method according to claim 1, wherein the pressure welding sheet is formed of a member that transmits the light ray, and in the irradiating step, the light ray is incident from a side of the transfer sheet.

3. The transfer method according to claim 2, wherein the transfer layer is formed of a metal foil layer, and in the irradiating step, the adhesive layer is thermally melted when a heat generating layer disposed on a front side in an incident direction of the light ray in the metal foil layer generates heat by the light ray.

4. The transfer method according to claim 3, wherein the heat generating layer is formed on the pressure welding sheet.

5. The transfer method according to claim 1, wherein the pressure welding step includes:

accommodating the medium and the transfer sheet in an inside of a bag body formed by using the pressure welding sheet; and generating the negative pressure between the pressure welding sheet and the medium by suctioning the inside of the bag body.

6. The transfer method according to claim 5, further comprising:

a mounting step of mounting the medium on a mounting portion of a jig formed with the mounting portion for mounting the medium, wherein in the pressure welding step, the inside of the sealed space is suctioned by the negative pressure, and the pressure welding sheet and the jig are pressure welded by the negative pressure to closely attach the transfer sheet and the medium.

7. The transfer method according to claim 1, wherein in the disposing step, the transfer sheet and the medium are accommodated inside a cup-shaped container from an opening portion of the cup-shaped container having the opening portion in which an upper surface side is opened, and the sealed space is formed by closing the opening portion of the cup-shaped container with a closing member in which at least one part is made of the pressure welding sheet.

8. The transfer method according to claim 2, wherein the pressure welding step includes:

accommodating the medium and the transfer sheet in an inside of a bag body formed by using the pressure welding sheet; and generating the negative pressure between the pressure welding sheet and the medium by suctioning the inside of the bag body.

9. The transfer method according to claim 3, wherein the pressure welding step includes:

accommodating the medium and the transfer sheet in an inside of a bag body formed by using the pressure welding sheet; and generating the negative pressure between the pressure welding sheet and the medium by suctioning the inside of the bag body.

10. The transfer method according to claim 4, wherein the pressure welding step includes:

accommodating the medium and the transfer sheet in an inside of a bag body formed by using the pressure welding sheet; and generating the negative pressure between the pressure welding sheet and the medium by suctioning the inside of the bag body.

* * * * *